US006082142A

United States Patent [19]

Kowitz

[11] Patent Number: 6,082,142

[45] Date of Patent: Jul. 4, 2000

[54] SINKER FOR SELECTION AND CONTROL OF LOOP-FORMING MOVEMENTS OF KNITTING IMPLEMENTS OF A KNITTING MACHINE

[75] Inventor: Claus Kowitz, Bad Ditzenbach, Germany

[73] Assignee: Hans Ruster GmbH & Co., Deggingen, Germany

[21] Appl. No.: 09/068,329

[22] PCT Filed: Oct. 1, 1996

[86] PCT No.: PCT/EP96/04284

§ 371 Date: Jun. 11, 1998

§ 102(e) Date: Jun. 11, 1998

[87] PCT Pub. No.: WO97/17486

PCT Pub. Date: May 15, 1997

[30] Foreign Application Priority Data

Nov. 7, 1996 [DE] Germany ..... 195 41 407

[51] Int. Cl.[7] ..... D04B 15/06

[52] U.S. Cl. ..... 66/104; 66/90

[58] Field of Search ..... 66/216, 217, 218, 66/219, 220, 221, 222, 104, 106, 107, 109, 110, 116, 123

[56] References Cited

U.S. PATENT DOCUMENTS

| | | | |
|---|---|---|---|
| 1,940,520 | 12/1933 | Zimic | 66/220 |
| 3,643,472 | 2/1972 | Apprich | 66/123 |
| 4,905,484 | 3/1990 | Schindler | 66/220 |
| 5,076,074 | 12/1991 | Halamoda et al. | 66/123 |

FOREIGN PATENT DOCUMENTS

| | | | |
|---|---|---|---|
| 311563 | 4/1989 | European Pat. Off. | 66/220 |
| 1760405 | 3/1974 | Germany | 66/123 |
| 3915684 | 5/1990 | Germany | 66/220 |
| 2099463 | 5/1981 | United Kingdom | 66/220 |

*Primary Examiner*—Danny Worrell

*Attorney, Agent, or Firm*—Antonelli, Terry, Stout & Kraus, LLP

[57] ABSTRACT

A control plate (17) for selecting and controlling knitting movements of tools in a knitting machine driven by the relative movements of the plate support (11) and a cam support (12), in which the control plate can be forced into an engagement position of a drive output foot (61) of the control plate with an output drive edge of an output drive component (73) to transmit the deflection drive by the action of a minimum pre-tension of an extended rod-shaped control spring (37), the free end of which is supported to slide on the base of a guide groove (16) accepting the control plate, is constructed as a one-piece spring steel component to simplify manufacture and increase its wear resistance, in which its width (h) measured perpendicularly to the neutral elastic line (54) of the control spring (37) at the base side of the spring at which it bears on the basic body (18) of the plate is greater than at the free end (48) of the spring by which the spring is supported on the base (25) of its guide groove (16), where the spring (17) bears on the basic body of the plate via a smooth curve widening the base region.

9 Claims, 3 Drawing Sheets

SINKER FOR SELECTION AND CONTROL OF LOOP-FORMING MOVEMENTS OF KNITTING IMPLEMENTS OF A KNITTING MACHINE

FIELD OF THE INVENTION

The invention relates to a sinker for selection and control of the loop-forming motions of knitting implements of a knitting machine to which is assigned a sinker which has the form of a flat bar according to basic shape as the control element which can be deflected in a guide groove of a sinker carrier in its longitudinal direction in alternative directions of movement

BACKGROUND AND SUMMARY OF THE INVENTION

In these knitting machines, for example, circular knitting machines which have a cylindrical sinker carrier which can be driven to rotate with vertical run of its central axis around it and which is located within the stator of the machine which has the form of a cylindrical jacket according to external shape and which coaxially surrounds the sinker carrier, the sinker carrier contains a plurality of sinkers, for example 2000 which are located next to one another in edge-open radial grooves which are equidistant in the azimuth direction, with a vertical run which is parallel to the center longitudinal axis of the plate carrier, in each of these grooves being a sinker which can move up and down.

For controlled driving of the sinkers in this regard, which takes place by relative rotational movements of the sinker carrier to the machine stator which is made as a cam carrier, the sinkers are provided with clearing feet which have contour edges which run transversely to the sinker guide direction; by their sliding away the deflections of the control sinkers are controlled via a drive cam of the stator provided with a clearing edge. In this case the control sinkers, by the action of a minimum prestress per control spring which proceeds from a base body of the sinker and which has a stretched rod shape in terms of basic shape, and which has a free end which is supported to slide on the base of the guide groove of the control sinker, are displaced into the engagement position of their clearing foot which transfers deflection driving, with the clearing edge of the clearing cam of the cam carrier. They can furthermore be displaced by control elements of the cam carrier and sinker carrier which work by force fit-form fit into a base position, in which the drive engagement of the clearing feet is cancelled with the clearing edge of the clearing cam. In this base position the sinkers can be fixed by the retaining force of a permanent magnet arrangement which has a holding action which can be cancelled by compensatory triggering of an electronically controllable magnet arrangement, so that the sinkers can be released by the action of the control springs for assuming the clearing position.

In known sinkers of this type (DE-39 15 684 C1) the control springs are made as spring steel rods with a cross section which is round, rectangular or uniform over its entire resilient length and with flattened anchoring pieces which are rectangular, flat-plate formed according to basic shape, and which has a thickness which is less than that of the sinker material which is equal to the diameter of the spring leg measured at a right angle to the longitudinal surfaces of the sinker, in flat groove-shaped depressions with cheek contour which is matched exactly to the contour of the anchoring pieces, anchored by force fit-form fit, the resilient rod passing through a short opening of the sinker material which discharges into an anchoring depression. To secure the spring rod against disarrangements in the anchoring depression of the sinker, on the edges of the depression which the anchoring section of the spring rod adjoins, there is caulking of the sinker material which in interaction with notches of the anchoring section yields a force-fit/form-fit connection of the spring rod with the sinker overall. The spring rods are fixed on the sinkers such that the center longitudinal axes of the spring rods run in the longitudinal center planes of the sinkers which extend between their large area shaft boundary surfaces.

The known sinkers are subject to at least the following disadvantages:

Production of the sinkers is complex and expensive, since the anchoring depressions of the sinkers and the anchoring end pieces of the spring elements must be matched to one another within narrow tolerances; this requires high-precision machining of the surfaces which touch one another. Joining of the sinker elements to be connected to one another requires time-consuming mounting effort which for its part is costly. Finally the caulking of the edges of the anchoring grooves of the sinker base body with the edges of the anchoring pieces of the springs in many cases can lead to undesirable bulges of the sinker shaft, by which likewise time-consuming remachining can become necessary. In addition, even minor imprecision in the anchoring area can lead, at least after some time, to loosening of the spring-sinker anchoring and to fracture thereof, for which reason sinker sets of the known type must be completely replaced after a certain operating time of the machine. This contributes significantly to operating costs of knitting machines equipped with sinkers of the known type.

The object of the invention is therefore to improve a sinker of the initially mentioned type such that with production costs which are clearly reduced nevertheless it can be built with improved quality and thus increased service life.

This object is achieved as claimed in the invention by the sinker including its control springs being made as a single-piece spring steel part, by the width (h) of the control spring, measured at right angles to their neutral bending line on the base side of the spring on which it adjoins the sinker base body, having a larger value than on the free spring end with which the control spring can be supported on the base of the guide groove, and by the control spring on its base side with smooth curvature which widens the base area adjoining the sinker base body.

The control sinker as claimed in the invention yields at least the following production and functional advantages:

It can be produced very efficiently as a stamping which requires if necessary only very little subsequent grinding and therefore can also be produced very economically.

The configuration of the sinker and control spring which is possible by the integral design thereof with a configuration of the spring base area which widens with a smooth curvature and which also passes into the sinker base body with a smooth curvature has the advantage that notch effects in the base area of the control spring and load-induced wear in the area in which the spring adjoins the sinker base body can be almost completely prevented and thus favorably high service lives of the sinker as claimed in the invention can be achieved.

This also applies with reference to the dimensioning of the spring width which decreases from the base side of the springs to its free end, by which on the one hand a uniform distribution of the bending load over the length of the control spring and on the other hand the desired force/spring path characteristic of the springs can be stipulated, which yields a favorable, especially rapid (switch) response behavior of the springs with a width in the preferred configuration of the control spring on the support end which corresponds to between 80 and 120% of the thickness of the sinker material and on the base side of the spring to between 150 and 250% of this thickness.

One especially advantageous configuration of the control sinker which is likewise used to achieve uniformity of the distribution of the prestress of the springs over their length consists in that the control springs in the clearing position of the sinker runs parallel or roughly parallel to the extended control shaft of the sinker which is provided on a middle section of its length on its longitudinal side facing away from the spring end with the clearing foot, and in that the control spring in its released configuration which it assumes before installation in the sinker carrier has a curvature which points away from the shaft with a radius of curvature which is greater than the spring length and corresponds to 5 to 8 times the spring length, preferably roughly 6.5 times.

If the radius of curvature with which the control spring smoothly adjoins the base body and the control shaft of the sinker has a value between 1.5 times and twice the value of the base width of the control spring, for a relatively large base width thereof a notching action in the spring base area can be reliably precluded.

In the preferred configuration of the control sinker its spring base, starting from which the smooth curvature begins with which the control spring passes into the sinker base body and the sinker control shaft which projects over the support end of the spring in the longitudinal direction, likewise with a smooth curvature, adjoins a support projection which points toward the free spring end, which is located on the spring side opposite the control shaft, which proceeds from the sinker base body, and which on its side facing away from the control spring can be supported with one obtuse-angled edge which marks one tilt axis of the sinker on the base of the guide groove.

This yields an arrangement of the control spring base which is so-to-speak displaced into the sinker base body, and with a stipulated support point of its spring end on the base of the guide groove there is a prolongation of the spring which in turn yields the possibility of a favorable stress distribution over the spring length.

For this purpose, to achieve a clearly increased service life of the spring, it is enough if length $l_b$ of the control spring section near the base and extending between the support projection and the control shaft of the sinker is between 7 and 15% of the spring length $L'_F$, preferably around 10% thereof.

In this configuration of the control sinker it is a good idea if the base of its control spring with the same radius of curvature smoothly adjoins the contour edges of the control shaft and the support projection which run adjacent to it, parallel or almost parallel to its longitudinal edges, to prevent undesirable notch effects it being sufficient if the radii of curvature with which the base of the control spring smoothly adjoins the adjacent control shaft and the support projection have values between the value of the base width of the spring and 1.5 times the value, preferably roughly 1.1 times the value.

Other details of the invention result from the following description of the embodiments using the drawings.

DETAILED DESCRIPTION OF DISCLOSED EMBODIMENTS

Figure 1B:
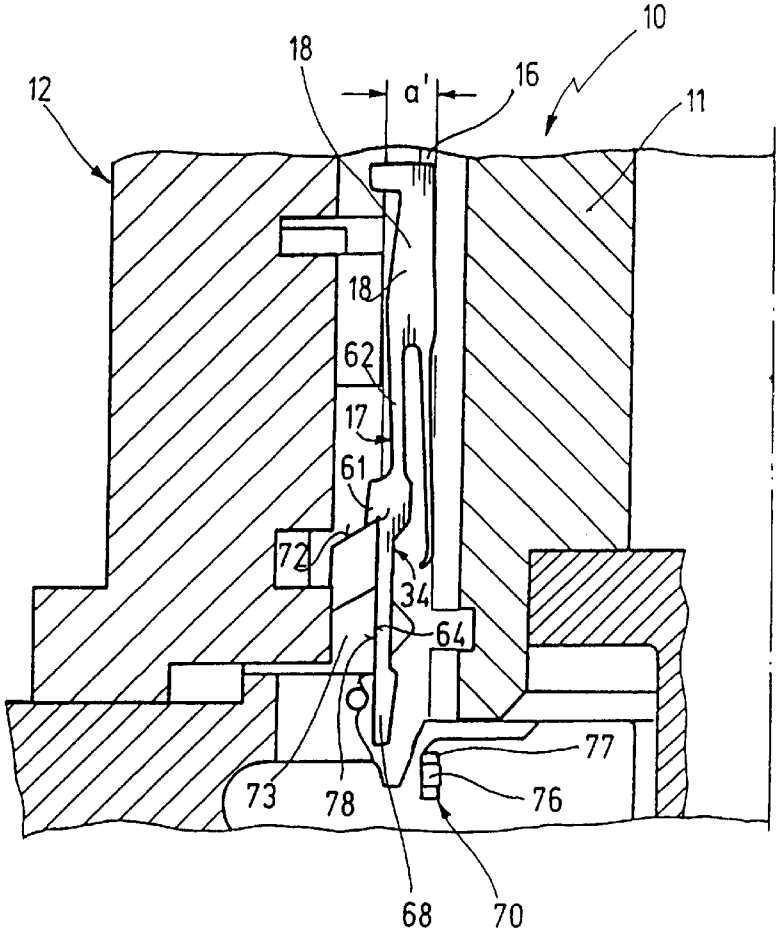
FIGS. 1*a* and 1*b* show alternative operating positions of a control sinker as claimed in the invention for explanation of its operation.
Figure 1A:
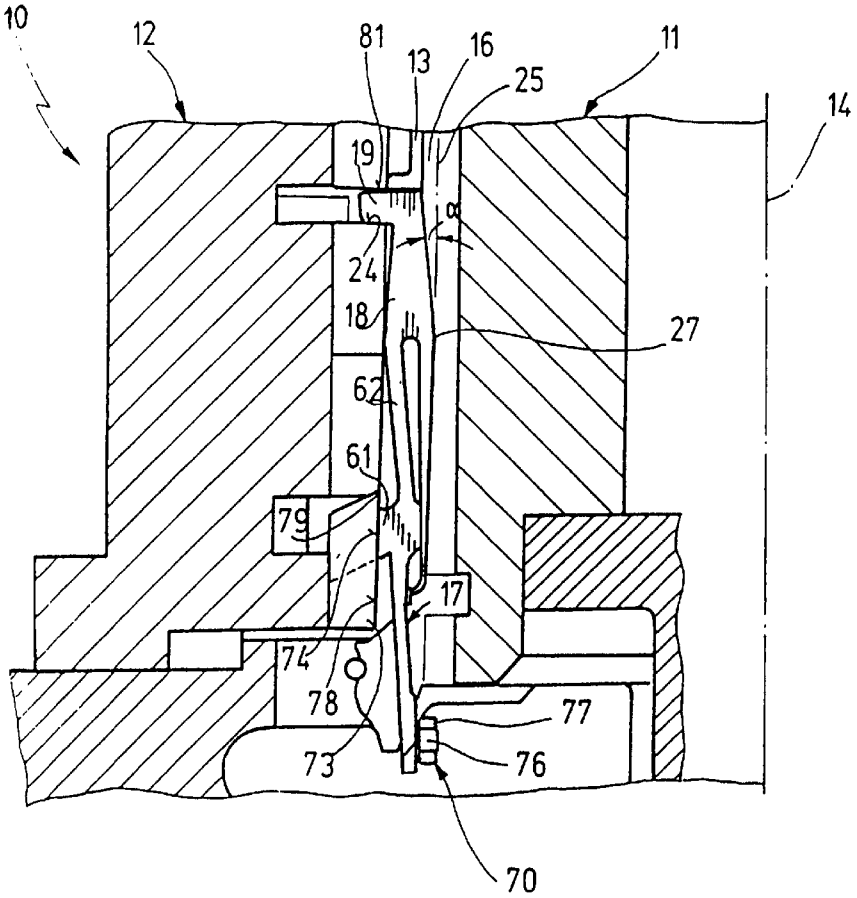

In FIGS. 1*a* and 1*b*, 10 labels a circular knitting machine which is represented by parts of its needle cylinder 11 and its cam cylinder 12 and which operates with electronically controllable selection of needles 13 which are used for loop formation for the purpose of achieving a programmably stipulated knitting pattern.

Knitting machine 10 is of that type in which needle cylinder 11 can be rotationally driven around central vertical axis 14, and cam cylinder 12, forming the stator of the round knitting machine 10, coaxially surrounds needle cylinder 11.

Needles 13 are guided to move vertically up and down over the periphery of the needle cylinder of equidistantly distributed needle channels 16, these needle channels being made as narrow grooves which are open towards cam cylinder 12 and which are assigned individually to needles 13. In one typical design of knitting machine 10 these 2000 needles can have needles 13 and needle channels 16 which are distributed for example on 40 knitting units on which one thread each is processed. The vertical up and down motions of needles 13 which are necessary for loop formation and which are superimposed on the rotational motion of the needle cylinder are controlled by sliding form-fit engagement of the radial control feet of needles 13, which are not shown, with needle cam paths of the cam cylinder 12 which are likewise not shown for the sake of simplicity. So that this type of motion control can take effect, needles 13 participating in the knitting process are moved from a true running position, which is shown in FIG. 1*a* and which is withdrawn as far as possible into needle cylinder 11 as the lowest position of the needles, into a knitting position which is raised compared to the true running position, beginning from which only the loop forming movements of needles 13 can be achieved which result due to the relative rotational movement of needle cylinder 11 relative to cam cylinder 12 by engagement of the control feet of the needles with the needle belt of cam cylinder 12.

To choose in this regard needles 13 to be activated for the knitting process and their lifting into the initial knitting position shown in FIG. 1*b*, there are control sinkers 17 assigned individually to needles 13 which for their part can be moved from the true running position which is shown in FIG. 1*a* and which corresponds as it were to the inactive state of needles 13 assigned to them, into the selection position which is shown in FIG. 1*b* and which is assumed compared to the true running position, and in which needle 13 assigned to this control sinker 17 is cleared out of its base running position so far that it can be deflected in the course of the relative rotary motion of needle cylinder 11 relative to cam cylinder 12 for executing the loop-forming up and down movements of needles 13 selected at the time. This is possible due to the form-fitted engagement of at least one radial needle pin with the guide path of cam cylinder 12 assigned to this, starting from the knitting position of sinker 17 which accordingly, regardless of the knitting deflections of needle 13 selected by it, can be guided back into its true running position, while the return of the needle into its true running position is dictated by the shape of the needle cam of cam cylinder 12 which is not shown.

Figure 2:
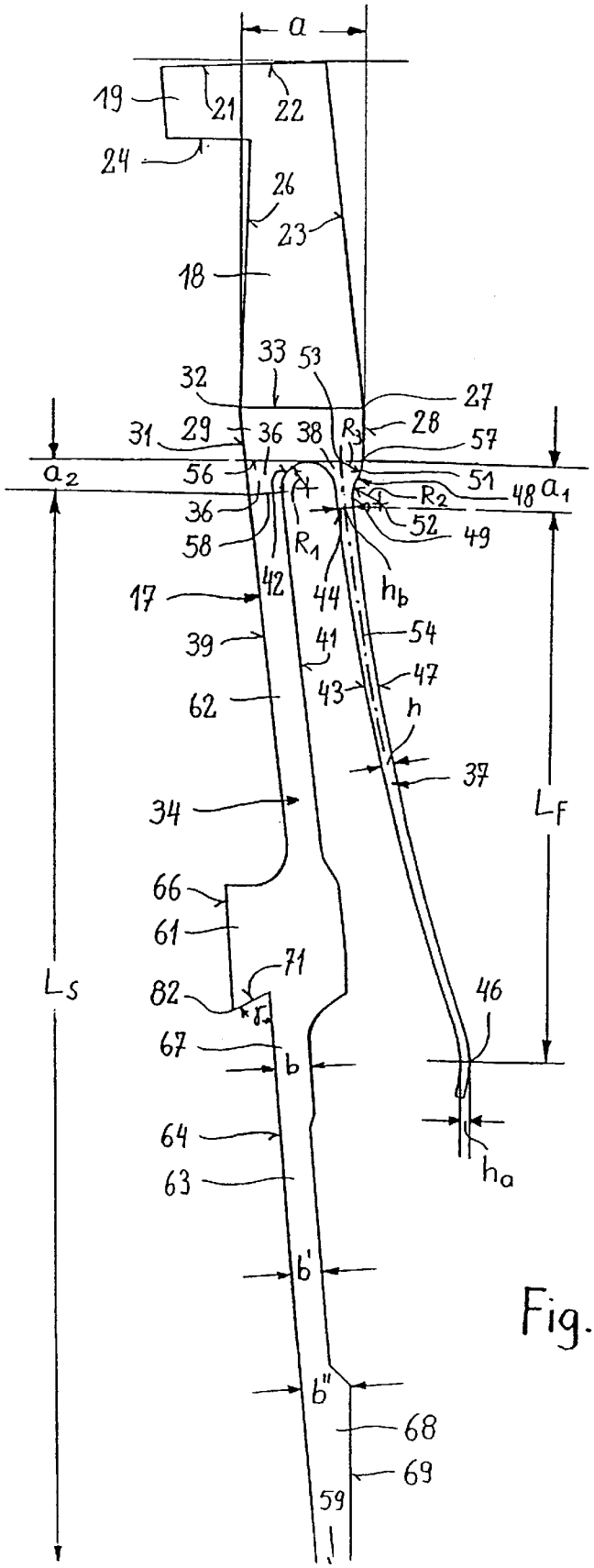
FIG. 2 shows the control sinker as shown in FIGS. 1*a* and 1*b* on an enlarged scale and FIG. 3 shows another embodiment in a view which corresponds to FIG. 2.

Control sinker 17 which is shown for itself alone in FIGS. 1*a* and 1*b* in alternative operating positions within knitting machine 10 and in FIG. 2, to the details of which reference is likewise made at this point, is stamped out of a spring steel strip which has a typical thickness between 0.4 and 0.6 mm, to which corresponds the slightly larger inside diameter of the grooves of needle cylinder 11 which form needle channels 16.

Sinker 17 with a configuration which can be taken in all essential details from the scaled representation of FIG. 2 has base body 18 which is roughly trapezoidal in its outlines and from which on the needle-side end of control sinker 17 burr-shaped extension 19 which projects on one side proceeds, and its needle-side transverse edge 21 which is flush with end face edge 22 of base body 18 and with an obtuse angle which is only slightly different from 90° adjoins sloped leg edge 23 of the base body 18 of control sinker 17, the leg edge being located radially to the inside in the operating positions of sinker 17 shown. Transverse edge 24 of burr-shaped extension 19 facing away from its needle-side transverse edge 21 adjoins roughly at a right angle radially externally sloped leg edge 26 of base body 18 which includes with it radially [an angle] of roughly 10°. This angle is slightly larger than tilt angle a (FIG. 1*a*) by which control sinker 17 can be tilted within needle channel 16 from the base running position shown in FIG. 1*a* into the clearing position shown in FIG. 1*b*, in which radially inner sloped leg edge 23 of base body 18 adjoins base 25 of groove-shaped needle channel 16. Pivot 27 of this possible tilt motion of control sinker 27 is marked by an obtusely angled corner edge, on which radially inner sloped leg edge 23 of base body 18 with an obtuse angle only slightly different from 180° adjoins radially inner, linearly running longitudinal edge 28 of base section 29 of control sinker 17 which is only short in its longitudinal direction. From base area 29 which also has straight boundary edge 31 on the radially outer side of the sinker, said edge with an obtuse angle only slightly different from 180°, marking corner edge 32 opposite pivot 27, adjoins radially outer sloped leg edge 26 of base body 18 of the sinker, there proceeds a control leg with the shape of an extended flat rod labelled 34 throughout, its base area 36 in the radially outer part of base section 29 adjoins the latter and is relatively stiff, and a resiliently bendable sinker leg labeled 37 throughout, with base area 38 which adjoins the radially inner part of base area 29 of base section 29 of control sinker 17.

Base area 36 of control leg 34 is the sinker section which is short relative to length $L_S$ of control leg 34, within which section radially outer straight longitudinal edge 39 adjoins collinearly straight outer longitudinal edge 31 of base section 29, on the one hand, and on the other, its radially inner longitudinal edge 41 which, running in the vicinity of base area 36 parallel to outer longitudinal edge 39 of control leg 34, with semicircular contour adjoins radially outer longitudinal edge 43 of spring leg 37, the extension of base area 36 of the control leg measured in its longitudinal direction corresponding to radius of curvature $R_1$ of curved contour 42. In a typical configuration of control sinker 17 this radius of curvature has a value of 1.5 mm.

Base area 38 of spring leg 37 is the section of the control sinker which is short compared to length $L_F$ between base 44 of spring leg 37 and its free support end 46 with which it can be supported on groove base 25 of needle channel 16; within this section radially inner longitudinal edge 47 of spring leg 37 with smoothly curved outline of its radially inner contour smoothly adjoins radially inner longitudinal edge 28 of base area 29, said edge running in a straight line, and the curved contour area with which radially inner longitudinal edge 47 of spring leg 37 smoothly adjoins radially inner straight longitudinal edge 28 of base area 29 has spring-side section 49 with concave curvature and base section-side section with a convex curvature, with radii of curvature $R_2$ and $R_3$ having the same size which in a typical configuration of control sinker 17 has a value around 2 mm, two areas of curvature 48 and 51, viewed from the respective curvature center point 52 and 53, extending over an azimuth range of roughly 45°. For the dimensions given as an embodiment this contributes to the extension of base area 38 of spring leg 37 measured in its longitudinal direction corresponding roughly to 1.5 times the longitudinal extension of base area 36 of control leg 43 measured in the same direction.

The longitudinal extension of base section 38 of spring leg 37 which can be compared here to its "spring" length $L_F$ is distance $a_1$ of base 44 which runs at a right angle to neutral bending line 54 of spring leg 37, from tangent 56 which runs parallel to base line 33 of base body 18 of control sinker 17 to contour area 42 which runs in a curve, with which radially inner longitudinal edge 41 of control leg 34 adjoins base section 29 of control sinker 17 and base section 38 of its spring leg 37, contour area 48 of this base section 38 arched concavely/convexly at the intersection point of tangent 56 with radially inner contour 47, 48, 28, 23 of control sinker 17 smoothly adjoining radially inner longitudinal edge 28 of base section 29 of control sinker 17, said edge running in a straight line.

Accordingly, the longitudinal extension of base section 36. of control leg 34 which can be compared to its effective length $L_S$ is distance $a_2$ of base line 58 of control leg 24 from tangent 56, said distance corresponding to radius of curvature $R_1$.

In the "released" state of control sinker 17 shown in FIG. 2, neutral bending line 54 of its spring leg 37 in the area of its base 44 runs parallel or roughly parallel to longitudinal edges 39 and 41 of control leg 34, the edges running for their part parallel to one another, with which this leg adjoins its base section 36.

Effective length $L_F$ of spring leg 37 measured between spring base 44 and free support end 46 of spring leg 37 which has a convex arch in the area of its support point is slightly larger than half the effective length $L_S$ of control leg 44 measured between its base line 58 and its free edge 59.

In the released state of spring leg 37 shown in FIG. 2, it has a slight curvature which points away from control leg 34 and which has an average radius of curvature corresponding to the contour of neutral bending line 54 which has a value which corresponds to roughly 4.5 times the spring length $L_F$.

Between base 44 and free support end 46 of spring leg 37 its width h measured at a right angle to neutral bending line 54 decreases continuously, leg width $h_b$ on base 44 of spring leg 37 corresponding to roughly 1.8 times the value of spring leg width $h_a$ on free support end 46 of spring leg 37. One typical value of base width hb of spring leg 37 at its length of roughly 32 mm and a thickness of the sinker material of 0.5 mm, is 0.9 mm; on free support end 46 of spring leg 37 this corresponds to a square cross section thereof.

Control leg 34 on its radially outer side has lug-shaped projection 61 which points towards cam cylinder 12 and by which initial section 62 of control leg 34 which is bounded by a straight line and which proceeds from base area 36 of the control leg is set off against support section 63 which projects over the end of spring leg 37, which has radially outer, i.e. pointing towards cam cylinder 12, longitudinal edge 64 which runs from lug-shaped projection 61 to free end edge 59 of control leg 34 in a straight line, with radially outer longitudinal edge 39 of initial section 62 it includes a small acute angle of roughly 2° and in the area of its connection to lug-shaped projection 61 relative to this longitudinal edge 39 of initial section 62 of control leg 34 it is offset radially to the outside by roughly width b of initial section 62. Free longitudinal edge 66 of lug-shaped projection 61 runs in a straight line and with radially outer longitudinal edge 64 of support section 63 of control leg 34 includes an acute angle of roughly 1°. The middle area of support section 63 which extends over roughly ⅖ of its length and which has a width b', which is somewhat smaller than the width of initial section 62 of support leg 34, and is roughly 80% thereof intervenes between initial area 67 of support section 63 following lug-shaped projection 61 and the end section of control leg 34 which forms a "radial" support foot, which is slenderly trapezoidal in basic shape, and which extends over roughly ⅓ of the length of support section 63.

Radially inner longitudinal edge 69 of radial support foot 68 with which it, viewed in the true running position of control sinker 17 (FIG. 1*a*), is supported radially on schematically shown control magnet arrangement 70, runs in a straight line and with straight radially outer longitudinal edge 64 of support section 63 it includes an acute angle of roughly 8°, greatest width b" of support foot 68 corresponding roughly to 1.6 times width b' of the middle area of support section 63. Between radially outer longitudinal edge 64 of support section 63 and radially outer longitudinal edge 66 of lug-shaped projection 61 of control leg 34 there extends straight support edge 71 which with radially outer longitudinal edge 64 of support section 63 of control leg 34 joins an acute angle which in the special embodiment shown has a value of roughly 68°. This "support" angle corresponds to angle of incline γ of peripheral slide-guide surface 72 of clearing cam 73, measured in the radial plane, on which control sinker 17 with sloped support edge 71 of its lug-shaped projection 61 which forms the clearing foot of control sinker 17 can be supported.

In the true running position of control sinker 17 shown in FIG. 1*a*, in needle channel 16 it assumes its lowest position, in which clearing foot 61 is forced into needle channel 16 and with its straight longitudinal edge 66 is radially supported to slide on the cylindrical jacket-shaped, radially inner peripheral area of clearing cam 73, which while control sinker 17 which rotates with needle cylinder 11 passes on this cylindrical jacket-shaped, peripheral area 74, forces end section 68 of control leg 34 with its radially inner longitudinal edge 69 into contact with permanent magnet 76 of the given knitting system of the circular knitting machine on which support foot 68 of control sinker 17 is supported to slide.

This permanent magnet 76 exerts an attractive force on support foot 68 of control leg 34 which is enough to keep the control leg in contact with the sinker against the repelling force of the control spring of control sinker 17, said spring formed by spring leg 37 and maximally prestressed in the base running position. Control magnet arrangement 70 of the respective knitting system furthermore comprises magnet coil 77, shown only schematically, which can be excited by a control current, and by whose excitation a demagnetizing field which cancels the attractive force of permanent magnet 76 can be produced, so that when magnet coil 77 is excited, control leg 74 of control sinker 17 by the action of its control spring 37 can reach the selection position shown in FIG. 1*b*, in which its clearing foot 61, projecting from needle channel 16, with its falling support edge 71 is vertically supported on likewise falling slide guide surface 72 of clearing part 73 and at the same time also radially outer straight longitudinal edge 64 of support section 63 of control leg 34 is radially supported to slide on jacket surface 78 of clearing cam 73, said surface being coaxial with central longitudinal axis 14 of knitting machine 10.

Clearing cam 73, viewed in the azimuth direction, has a height which varies periodically by at least the amount of the stroke by which control sinker 17 can be moved up and down in needle channel 16, rising and falling as well as horizontally running sections of blade-shaped guide edge 79 of clearing cam 73 adjoining one another "smoothly,—"in an undulating manner"—.

The corresponding applies analogously to the run of the slide surface of the reset guide path of cam cylinder 12 on which upper end face edge 21 of burr-shaped extension 19 of control sinker 17 acting as a reset foot can be supported to slide.

Selection triggering of control sinker 17 for its lifting from the true running position shown in FIG. 1*a* is possible when the control sinker passes by on an area of shorter height of clearing cam 73 for which guide edge 79 of clearing cam 73, as shown by the broken line, runs under edge corner 82 of sinker clearing foot 61 on which its sloped support edge 71 adjoins its free longitudinal edge 66. If in this position of control sinker 17 the attractive action of permanent magnet 76 is cancelled by compensatory triggering of magnet coil 77, control sinker 17 is tilted by the action of prestress of spring leg 37 around pivot 27, by which clearing foot 61 of the sinker reaches radially to the outside into the position which traverses guide edge 79 and the following area of slide guide surface 72 of clearing cam 73 and in which at this point the control sinker, likewise riding with its clearing foot 61 on guide edge 79 of clearing cam 73, by its relative motion compared to the rising section of guide edge 79 of clearing cam 73 is raised into the selection position shown in FIG. 1*b*. In this position of the control sinker in which its base body 18, compared to the true running position, is tilted by angle a, and with its sloped leg edge is supported on groove base 25 of needle channel 16, neutral bending line 54 of spring leg 37 runs roughly parallel to longitudinal edges 39 and 41 of initial section 62 of control leg 34 of control sinker 17, conversely in the true running position initial section 62 of control leg 34 and spring leg 37 of the sinker include an acute angle with one another.

Figure 3:
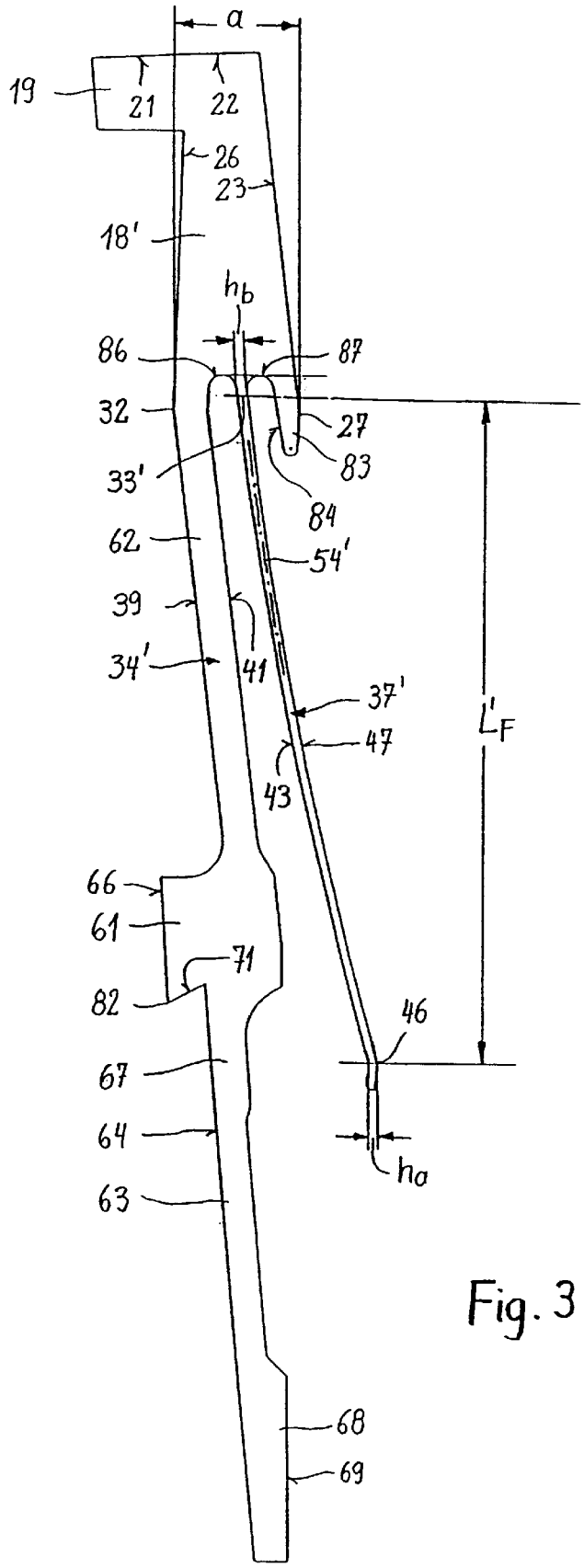

Control sinker 17' shown in FIG. 3 as another embodiment is functionally analogous to control sinker 17 as shown in FIG. 2 and differs from it solely by the configuration of the transition areas via which control leg 34' and spring leg 37' adjoin base body 18' of control sinker 17', with a configuration otherwise the same as described using control sinker 17 as shown in FIG. 2. To the extent the same reference numbers are used in FIG. 3 as in FIG. 2 without the components of control sinker 17' labelled thereby being mentioned specifically in the explanations, this should contain the reference to the description given using FIG. 2.

For control sinker 17', for purposes of explanation, it is assumed that instead of control sinker 17 as shown in FIG. 2 it can be used with the same function in knitting machine 10 and accordingly the orientation and length of sloped leg edges 23 and 26 of its trapezoidal base body 18' which has the same base width a which is measured between tilt edge 27 and obtuse-angled corner edge 32 opposite it, the same configurations of its reset foot 19, its clearing foot 61 with distances from one another measured in the displacement direction of control sinker 17', and the same arrangement of support end 46 of spring leg 37' with reference to clearing foot 61 of control sinker 17', as in control sinker 17 as shown in FIG. 2. The following details are different compared to FIG. 2 in sinker 17' shown in FIG. 3:

The distance of base 33' of spring leg 37', up to which radially outer longitudinal edge 43 and radially inner longitudinal edge 47 of the spring leg, viewed in its released state which is shown, run between free support end 46 and spring base 33 with constant radius of curvature, from end face edge 22 of trapezoidal base body 18' of control sinker 17', is smaller than the distances of obtuse-angled corners 27 and 32 of sinker base body 19 measured from its end face edge 22. Base 33' of spring leg 37' is likewise moved "into" base body 18' so that, compared to the embodiment shown in FIG. 2, there is a greater length $L_F$ of spring leg 37' which is roughly 15% greater than length $L'_F$ of spring leg 37 of control sinker 17 as shown in FIG. 2. The radius of curvature which is averaged between the radii of curvature of radially outer longitudinal edge 43 and radially inner longitudinal edge 47 of spring leg 37' and which corresponds to the run of neutral bending line 54' of spring leg 37' roughly corresponds to 6 times the length of the spring leg $L'_F$.

Base width $h'_b$ of spring leg 37' is only roughly 20% larger than its width $h_a$ on free support end 46.

Obtuse-angled edge 27 which marks the pivot around which sinker 17' can be tilted and which can be supported on groove base 25 of needle channel 16 which accommodates control sinker 17' is located on support projection 83 which extends, measured from spring base 33', over roughly 1/10 of spring leg length $L'_F$; radially outer longitudinal edge 84 of the projection facing spring leg 37' in base area 33' runs parallel to neutral bending line 54' of spring leg 37'.

Between radially inner longitudinal edge 41 of initial section 62 of control leg 34' of control sinker 17' and radially outer longitudinal edge 43 of its control leg 37', on the one hand, and between radially inner longitudinal edge 47 of spring leg 37' and radially outer longitudinal edge 84 of support projection 83 of control sinker 17', on the other, there mediate contour regions 86 and 87 which are curved in a 180° arc shape with a smooth connection, which have the same radii of curvature which have a value of 0.75 mm in the embodiment selected for explanation. These relatively small radii of curvature are sufficient, with the given measurements of control sinker 17' with dimensions which otherwise correspond to those of control sinker 17 as shown in FIG. 2, to reliably preclude notch effects in base area 33' of control sinker 17'.

What is claimed is:

1. Control sinker for selection and control of loop-forming motions of knitting implements of a knitting machine comprising a plurality of control sinkers assigned to respective ones of said knitting implements, each of said plurality of sinkers having a form of a stretched flat bar for use as a control element in said knitting machine that can be deflected in a guide groove of a sinker carrier of the knitting machine in the longitudinal direction of said guide groove in alternative directions, wherein said sinker carrier of said machine comprises a plurality of said guide grooves running parallel to one another and located equidistantly next to one another, for holding one control sinker at a time, with driving thereof taking place by relative movements of the sinker carrier and a cam carrier of said knitting machine, said cam carrier having a clearing cam with a clearing edge that with said relative movements passes by the control sinkers on contour edges of lug-shaped clearing feet of said control sinkers, said edges running transversely to said longitudinal sinker guide groove direction, for controlling deflections of the control sinkers, and the control sinkers each having a control spring proceeding from a base body of the respective sinker, said base body having the shape of a stretched rod, and wherein said control spring has a free end which is supported to slide on the base of the guide groove for the control sinker in said sinker carrier, and said control spring being prestressed such that the clearing feet of the control sinkers are displaced into a clearing position of drive engagement of their clearing foot for transferring deflection driving, with the clearing edge of the clearing cam of the cam carrier, furthermore the control sinkers are displaced by control elements of the cam carrier and sinker carrier from said clearing position into a base position where the drive engagement of their clearing feet with the clearing edge of the clearing cam is interrupted, in this base position the sinkers are fixed by the retaining force of a permanent magnet arrangement of said knitting machine and are released by compensatory triggering of an electronically controllable magnet arrangement of said knitting machine for passage into the clearing position, and wherein said control sinker including its control spring is made of a single-piece spring steel part, a width of said control spring, measured at right angles to a neutral bending line of said control spring in a released state, on a base side of the spring adjoining said sinker base body, has a larger value than on said free end thereof where said spring is supported on a base of its guide groove, and wherein said spring on its base side adjoins the sinker base body with smooth curvature which widens the base area of said spring.

2. Control sinker as claimed in claim 1, wherein said width of said control on said free spring end thereof is between 80 and 120% and on its base side is between 150 and 250% of the spring thickness.

3. Control sinker as claimed in claim 1, wherein said control spring in the clearing position of the sinker runs parallel to a stretched control shaft of the sinker, said control shaft having a clearing foot on a middle section of its length on its longitudinal side facing away from said control spring, and said control spring having in its released state a configuration with a curvature in a direction away from said control shaft, a radius of said curvature being greater than the length of said control spring.

4. Control sinker as claimed in claim 3, wherein the radius of curvature of said control spring has a value which is between 5 and 8 times the spring length.

5. Control sinker as claimed in claim 3, wherein the radius of curvature with which the control spring smoothly adjoins the sinker base body and the control shaft of the sinker is between 1.5 times and twice the value of the base width of the control spring.

6. Control sinker as claimed in claim 3, wherein said control spring base, starting from which said smooth curvature begins with said control spring adjoining said sinker base body, wherein said control shaft of said sinker projects over the free spring end of said spring in the longitudinal direction, and wherein a further smooth curvature adjoins a support projection pointing towards said free end, of said control spring and located on the side of said control spring opposite said control shaft, and proceeding from said sinker base body, and wherein on the side of said projection facing away from the control spring said projection having an obtuse-angled edge which marks a tilt axis of the sinker for supporting said control spring on the base of its guide groove.

7. Control sinker as claimed in claim 6, wherein a length of a section of said control spring near the base and extending between said support projection and said control shaft of said sinker is between 7 and 15% of the length of said control spring.

8. Control sinker as claimed in claim 6, wherein said base of said control spring smoothly adjoins contour edges of said control shaft and said support projection with curvatures having the same radius of curvature which run adjacent to it, parallel to longitudinal edges of said control spring.

9. Control sinker as claimed in claim 6, wherein the radii of curvature of said smooth curvatures with which said base of said control spring smoothly adjoins adjacent control shaft and the support projection of said sinker have values between the value of the base width of said control spring and 1.5 times said value.

* * * * *